US009812810B2

(12) United States Patent
Arai et al.

(10) Patent No.: US 9,812,810 B2
(45) Date of Patent: Nov. 7, 2017

(54) WATERPROOF CONNECTOR

(71) Applicant: JAPAN AVIATION ELECTRONICS INDUSTRY, LIMITED, Tokyo (JP)

(72) Inventors: Katsumi Arai, Tokyo (JP); Hiroshi Akimoto, Tokyo (JP); Fumiki Yamada, Tokyo (JP); Toshiyuki Shimoda, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/482,279

(22) Filed: Apr. 7, 2017

(65) Prior Publication Data

US 2017/0214172 A1 Jul. 27, 2017

Related U.S. Application Data

(63) Continuation of application No. PCT/JP2015/067455, filed on Jun. 17, 2015.

(30) Foreign Application Priority Data

Oct. 27, 2014 (JP) ..... 2014-218160

(51) Int. Cl.
*H01R 13/648* (2006.01)
*H01R 13/523* (2006.01)
(Continued)

(52) U.S. Cl.
CPC ..... *H01R 13/523* (2013.01); *H01R 13/41* (2013.01); *H01R 13/521* (2013.01); *H01R 13/6581* (2013.01)

(58) Field of Classification Search
CPC ..... H01R 13/658; H01R 13/65802; H01R 13/6658; H01R 43/24; H01R 9/032
(Continued)

(56) References Cited

U.S. PATENT DOCUMENTS 7,736,186 B2 * 6/2010 Li ..... H01R 13/627 439/607.55
7,798,853 B2 * 9/2010 Shi ..... H01R 13/6658 439/607.58
(Continued)

FOREIGN PATENT DOCUMENTS

JP 2012-059540 A 3/2012
JP 2014-032784 A 2/2014
JP 2014-049411 A 3/2014

*Primary Examiner* — Hien Vu
(74) *Attorney, Agent, or Firm* — Muncy, Geissler, Olds & Lowe, P.C.

(57) ABSTRACT

A waterproof connector includes a housing made of an insulating resin and having a counter connector accommodating section and one or more contacts formed integrally with the housing, the housing having at least one contact adhesion generating recess that is formed in a bottom section of the counter connector accommodating section to communicate with an inside of the counter connector accommodating section and that allows an adhesion force directed to a contact-side fixed section of each of the one or more contacts to be generated at a portion of the housing in contact with the contact-side fixed section by means of water pressure occurring when the inside of the counter connector accommodating section is immersed in water.

8 Claims, 5 Drawing Sheets

(51) Int. Cl.
*H01R 13/41* (2006.01)
*H01R 13/52* (2006.01)
*H01R 13/6581* (2011.01)

(58) Field of Classification Search
USPC ..... 439/607.58, 607.4, 607.04
See application file for complete search history.

(56) References Cited

U.S. PATENT DOCUMENTS 8,662,927 B2 * 3/2014 Yu ..... H01R 4/023
439/498
8,662,928 B1 * 3/2014 Xie ..... H01R 12/724
439/607.35

* cited by examiner

WATERPROOF CONNECTOR

BACKGROUND OF THE INVENTION

The present invention relates to a waterproof connector, particularly to a waterproof connector in which one or more contacts are formed integrally with a housing made of an insulating resin.

Recently, electronic devices such as computers and mobile phones have been widely spread, and these electronic devices are normally equipped with connectors to be connected with external devices to transmit signals. Electronic devices are required to have an excellent waterproof function, and accordingly, waterproof connectors with waterproof properties have been under development.

In addition, to prevent transmitted electric signals from being affected by electromagnetic waves from outside, connectors shielded against electromagnetic waves have been desired.

Such a connector having both waterproof properties and electromagnetic wave shielding properties is disclosed in, for instance, JP 2012-59540 A. This connector has the configuration in which, as shown in FIG. 13, a counter connector accommodating section 2 accommodating a counter connector is formed in a cylindrical shell 1 made of metal, contacts 3 for establishing conductive connection are disposed in the counter connector accommodating section 2, and a housing 4 made of an insulating resin is formed by molding, e.g., insert molding, to integrally include the shell 1 and the contacts 3.

Each of the contacts 3 is formed at its one end with a contact section 3A exposed in the counter connector accommodating section 2 to come into contact with a contact of a counter connector and at its other end with a board connecting section 3B exposed behind the housing 4 to be connected to a board. A fixed section 3C between the contact section 3A and the board connecting section 3B is embedded in the housing 4 to thereby fix the contact 3 to the housing 4.

Since the housing 4 is formed by molding integrally with the contacts 3 to include the contacts 3 therein, a surface of the fixed section 3C of the contact 3 tightly adheres to the insulating resin forming the housing 4, and water is therefore prevented from penetrating from the outside of the connector, through a boundary portion between the housing 4 and the contact 3, to the rear of the housing 4, i.e., to the side at which a board having mounted thereon the connector is placed.

If, however, an electronic device to which the connector is attached sinks in water so that water enters the counter connector accommodating section 2 of the connector, water pressure P is applied to the portion of the housing 4 making up a bottom section 5 of the counter connector accommodating section 2 in a fitting direction, and due to the water pressure P, a shear force acting in the fitting direction is generated between the fixed section 3C of the contact 3 and the housing 4. As a result, the insulating resin forming the housing 4 may be separated from a surface of the fixed section 3C of the contact 3, thereby impairing waterproof properties of the connector.

SUMMARY OF THE INVENTION

The present invention has been made to eliminate the conventional drawback as above and is aimed at providing a waterproof connector that can maintain waterproof properties even when the inside of a counter connector accommodating section is immersed in water and applied with water pressure.

A waterproof connector according to the present invention includes:

a housing made of an insulating resin and having a counter connector accommodating section that is a recess opening in a fitting direction in which the waterproof connector is fitted with a counter connector and that accommodates the counter connector; and one or more contacts formed integrally with the housing, wherein the one or more contacts each have a contact section projecting from, as viewed in the fitting direction, a bottom section of the counter connector accommodating section of the housing in the counter connector accommodating section so as to be connected to a contact of the counter connector, a contact-side board connecting section exposed from the housing and connected to a board, and a contact-side fixed section connecting the contact section and the contact-side board connecting section and embedded in the housing, and wherein the housing has at least one contact adhesion generating recess that is formed in the bottom section of the counter connector accommodating section to communicate with an inside of the counter connector accommodating section and that allows an adhesion force directed to the contact-side fixed section of each of the one or more contacts to be generated at a portion of the housing in contact with the contact-side fixed section by means of water pressure occurring when the inside of the counter connector accommodating section is immersed in water.

DETAILED DESCRIPTION OF THE INVENTION

Embodiments of the present invention are described below based on the appended drawings.

Embodiment 1

Figure 1:
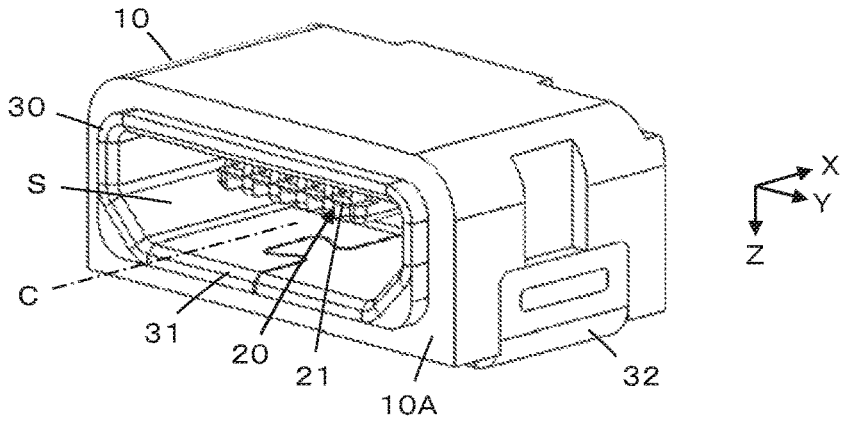
FIG. 1 is a perspective view showing a waterproof connector according to Embodiment 1 of the present invention.

FIG. 1 shows the structure of a waterproof connector according to Embodiment 1 of the present invention. The waterproof connector includes a housing 10 having a substantially cuboid outer shape, a plurality of contacts 20 fixed to the housing 10, and a shell 30 fixed to the housing 10 and configured to shield the contacts 20. The housing 10 is made of an insulating resin, and the contacts 20 and the shell 30 are made of a metal material having conductivity.

The housing 10 has a counter connector accommodating section S that is a recess opening at a front surface 10A side of the housing 10 along a fitting axis C between the housing 10 and a counter connector which is not shown, and the shell 30 has a hollow fitted section 31 that is disposed in the counter connector accommodating section S and is to be fitted with a counter connector. The shell 30 further has a pair of shell-side board connecting sections 32 that are exposed to the outside of the housing 10.

Figure 2:
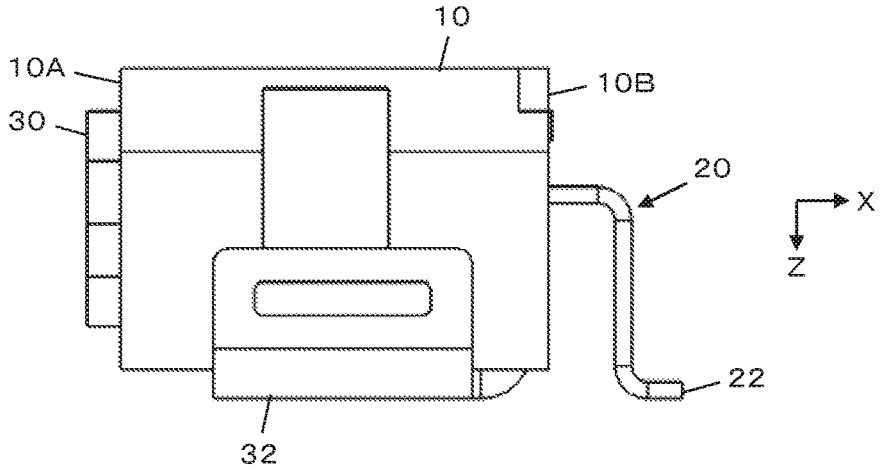
FIG. 2 is a side view showing the waterproof connector of Embodiment 1.

The contacts 20 are arranged in a direction perpendicular to the fitting axis C, and a contact section 21 provided at the front end of each contact 20 lies in the fitted section 31 of the shell 30. On the other hand, a contact-side board connecting section 22 provided at the rear end of each contact 20 is exposed from a rear surface 10B of the housing 10 to the outside of the housing 10 as shown in FIG. 2.

For convenience, the direction extending from the front surface 10A to the rear surface 10B of the housing 10 in parallel to the fitting axis C is referred to as "X direction," the arrangement direction of the contacts 20 "Y direction," and the direction perpendicular to the X and Y directions "Z direction."

Figure 3:
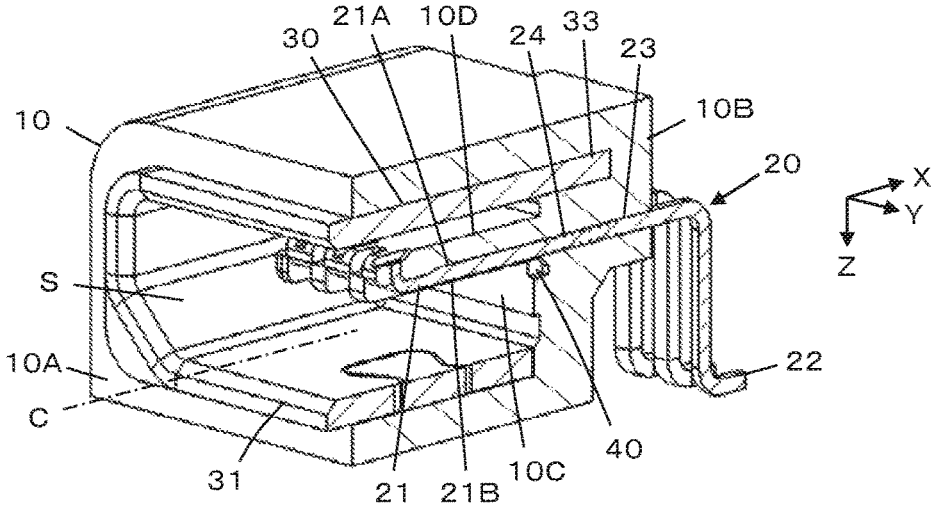
FIG. 3 is a perspective view showing the waterproof connector according to Embodiment 1 cut at the position where one contact lies.
Figure 4:
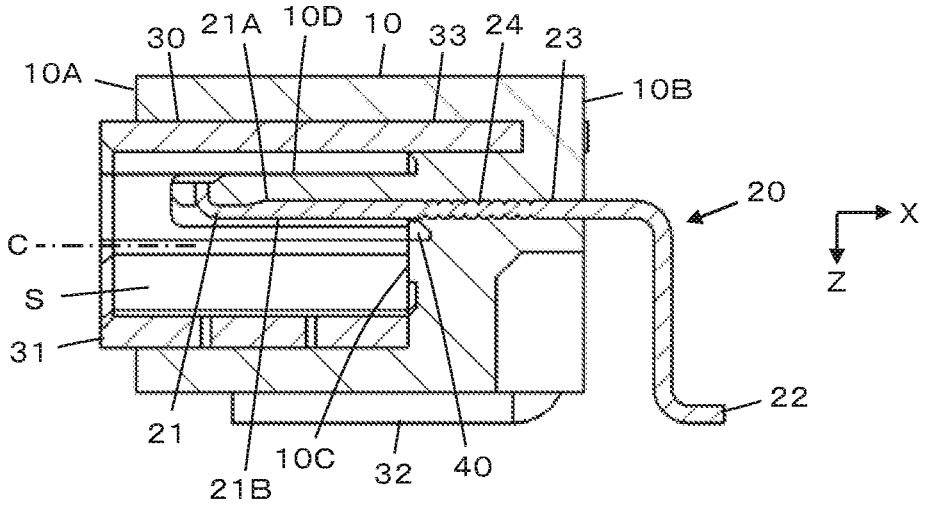
FIG. 4 is a cross-sectional view showing the waterproof connector according to Embodiment 1 cut at the position where one contact lies.

As shown in FIGS. 3 and 4, the housing 10 has a bottom section 10C in the counter connector accommodating section S in the direction of the fitting axis C and a tongue section 10D extending from the bottom section 10C in the −X direction, that is, toward the front surface 10A in parallel to the fitting axis C.

The contacts 20 are each formed of a bar-shaped member or a flat plate member. The contact section 21 projects from the bottom section 10C of the counter connector accommodating section S of the housing 10 as viewed in the fitting direction toward the −X direction in the counter connector accommodating section S, a surface 21A of the contact section 21 facing in the −Z direction is in contact with the tongue section 10D of the housing 10 to be held thereby, and a surface 21B opposite from the surface 21A and facing in the +Z direction is disengaged in the counter connector accommodating section S. The contact 20 further has, between the contact section 21 and the contact-side board connecting section 22, a contact-side fixed section 23 embedded in the housing 10 to fix the contact 20 to the housing 10.

A contact-side waterproof shaped section 24 composed of a plurality of grooves or protrusions arranged in parallel to each other is formed around the outer peripheral surface of the contact-side fixed section 23 to block the entry of water along the interface between the contact-side fixed section 23 and the housing 10.

The shell 30 includes a shell-side fixed section 33 that connects the fitted section 31 and the pair of shell-side board connecting sections 32 and is embedded in the housing 10 to fix the shell 30 to the housing 10. The shell-side fixed section 33 extends from a +X direction-side end of a −Z direction-side portion of the hollow fitted section 31 in the +X direction in the housing 10, and further extends through the housing 10 to be connected to the pair of shell-side board connecting sections 32.

The contact-side fixed section 23 and the shell-side fixed section 33 as above are embedded in the housing 10 when the housing 10 is formed by molding together with the contacts 20 and the shell 30.

In addition, a contact adhesion generating recess 40 is formed in the bottom section 10C of the housing 10 at a root region of the contact section 21 of each contact 20 in the vicinity of the surface 21B facing in the +Z direction. The contact adhesion generating recess 40 is in a shape recessed from the surface of the bottom section 10C of the housing 10 toward the rear surface 10B of the housing 10 along the fitting axis C and communicates with the counter connector accommodating section S.

When an electronic device to which the connector is attached sinks in water, the contact adhesion generating recess 40 serves to allow a portion 10E of the housing 10 in contact with the contact-side fixed section 23 to tightly adhere to the contact-side fixed section 23 by means of water pressure acting on the inner wall surface of the contact adhesion generating recess 40.

Figure 5:
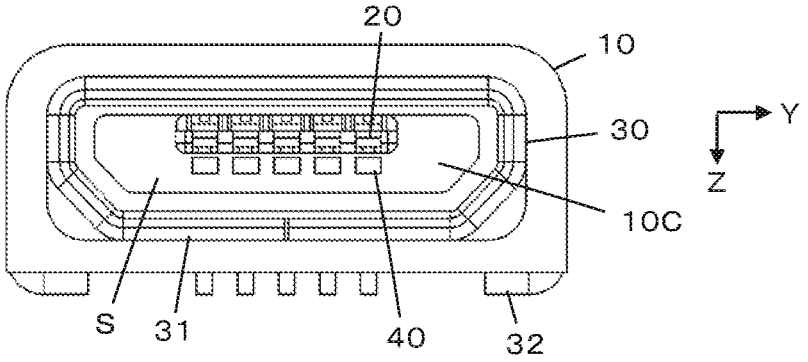
FIG. 5 is a front view showing the waterproof connector of Embodiment 1.

As shown in FIG. 5, a plurality of the contact adhesion generating recesses 40 are provided in a corresponding manner to the plurality of contacts 20.

Figure 6:
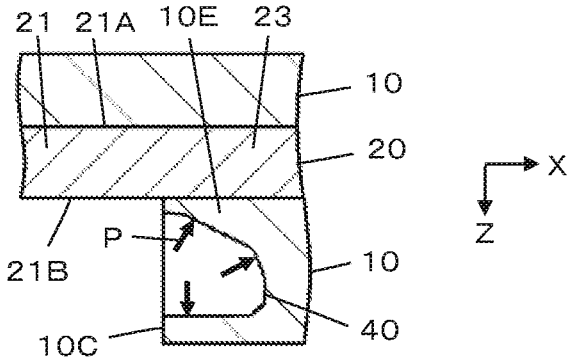
FIG. 6 is a cross-sectional view showing a contact adhesion generating recess used in the waterproof connector of Embodiment 1.

The waterproof connector according to Embodiment 1 is, for instance, mounted on a board attached to the inside of a casing of an electronic device, such as a personal digital assistant, with the counter connector accommodating section S being exposed to the outside of the casing of the electronic device and the housing 10 being protected at its surroundings from water in the casing of the electronic device by means of a waterproof mechanism which is not shown. When, however, the electronic device falls in water for example and the inside of the counter connector accommodating section S of the waterproof connector attached to the electronic device is immersed in water, water also enters the contact adhesion generating recess 40 communicating with the counter connector accommodating section S and, as shown in FIG. 6, water pressure P is applied to the inner wall surface of the contact adhesion generating recess 40. While the water pressure P is applied over the entire inner wall surface of the contact adhesion generating recess 40 in directions perpendicular to the respective places of the inner wall surface, the housing 10 formed of an insulating resin potentially has a certain degree of elasticity as well as rigidity, and the housing 10 is supported by the board or casing of the electronic device which is not shown. Therefore, an adhesion force directed to the contact-side fixed section 23 is generated at the portion 10E of the housing 10 in contact with the contact-side fixed section 23 by means of the water pressure P, which makes it possible to effectively prevent water from penetrating in the +X direction along the interface between the +Z direction-side surface of the contact-side fixed section 23 and the housing 10. The water pressure P acting in a direction away from the contact-side fixed section 23, that is, in the +Z direction is received by the board or casing of the electronic device (not shown) that supports the housing 10.

Supposing that the contact adhesion generating recess 40 is not provided in the bottom section 10C of the housing 10, the water pressure P generates only a shear force acting in the fitting direction between the contact-side fixed section 23 and the housing 10. Meanwhile, the provision of the contact adhesion generating recess 40 makes it possible to allow the portion 10E of the housing 10 in contact with the contact-side fixed section 23 to adhere to the contact-side fixed section 23 by means of the water pressure P, thereby preventing the housing 10 from separating from the contact-side fixed section 23 to improve waterproof properties.

Since the plurality of contact adhesion generating recesses 40 are provided in the bottom section 10C of the housing 10 in a corresponding manner to the plurality of contacts 20, the portions 10E of the housing 10 adhere to the contact-side fixed sections 23 of the corresponding contacts 20 by the contact adhesion generating recesses 40.

In addition, as described above, the contact-side waterproof shaped section 24 is formed around the outer peripheral surface of the contact-side fixed section of each contact 20 and therefore, in combination with a waterproof effect attributable to the contact adhesion generating recesses 40, water can efficiently be prevented from penetrating from the counter connector accommodating section S, through boundary portions between the housing 10 and the contacts 20, to the rear surface 10B side of the housing 10, i.e., to the side at which a board having mounted thereon the waterproof connector is placed.

When a counter connector is inserted in the counter connector accommodating section S of the thus configured waterproof connector along the fitting axis C and fitted to the fitted section 31 of the shell 30, a plurality of contacts of the counter connector come into contact with the contact sections 21 of the contacts 20 arranged in the counter connector accommodating section S, whereby the counter connector and the waterproof connector are electrically connected to each other.

Even in the fitted state with a counter connector, each of the contact adhesion generating recesses 40 is not blocked by the counter connector but remains communicating with the counter connector accommodating section S.

Embodiment 2

While the contact adhesion generating recess 40 used in Embodiment 1 has a curved portion that is curved from the bottom section 10C of the housing 10 in the vicinity of the surface 21B of the contact section 21 toward the +X and +Z directions and a flat portion that is positioned at the +Z direction side of the curved portion and extends along an XY plane as shown in FIG. 6, the invention is not limited thereto.

Figure 7A:
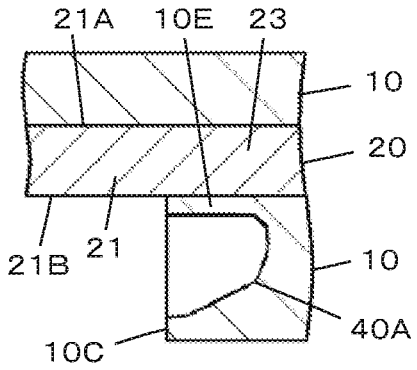
FIGS. 7A to 7E are cross-sectional views showing various contact adhesion generating recesses used in waterproof connectors of Embodiment 2.

For instance, a contact adhesion generating recess 40A may be used which has a shape formed by inverting the contact adhesion generating recess 40 of FIG. 6 in the Z direction, i.e., has a flat portion that extends from the bottom section 10C of the housing 10 in the vicinity of the surface 21B of the contact section 21 along an XY plane and a curved portion that is positioned at the +Z direction side of the flat portion as shown in FIG. 7A.

Figure 7B:
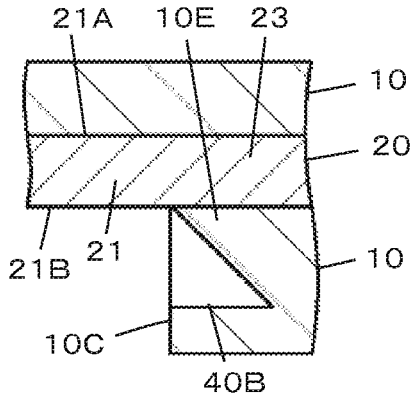
Figure 7C:
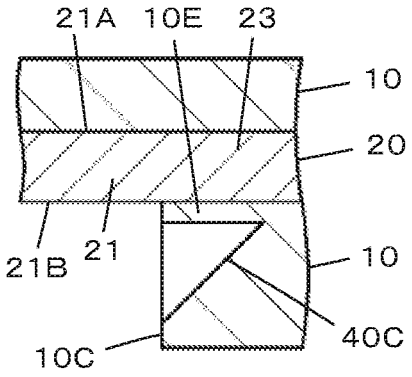

Aside from that, use may be made of a contact adhesion generating recess 40B having a right triangular shape in cross section as shown in FIG. 7B or a contact adhesion generating recess 40C having a sectional shape formed by inverting the contact adhesion generating recess 40B of FIG. 7B in the Z direction as shown in FIG. 7C.

Besides, a contact adhesion generating recess having a rectangular shape in cross section may be formed.

Figure 7D:
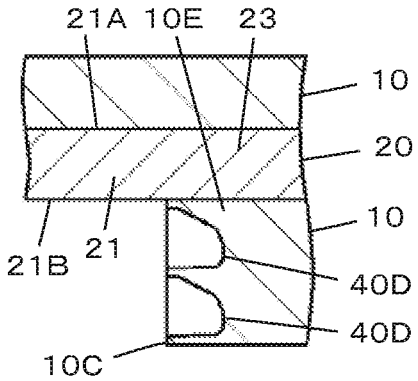

A plurality of contact adhesion generating recesses may be formed for one contact 20. For example, as shown in FIG. 7D, two contact adhesion generating recesses 40D each having a curved portion and a flat portion as with the contact adhesion generating recess 40 of FIG. 6 may be arranged one above the other in the direction perpendicular to the surface 21B of the contact section 21. In this case, the water pressure P applied to the inner wall surfaces of the two contact adhesion generating recesses 40D allows stresses directed to the contact-side fixed section 23 to be generated at the portion 10E of the housing 10 in contact with the contact-side fixed section 23, and an adhesion force resulting from combined stresses acts.

Figure 7E:
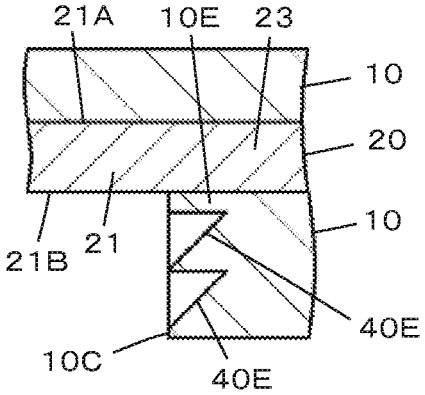

As shown in FIG. 7E, two contact adhesion generating recesses 40E each having a right triangular shape in cross section as with the contact adhesion generating recess 40C shown in FIG. 7C may be arranged one above the other in the direction perpendicular to the surface 21B of the contact section 21. Aside from that, two contact adhesion generating recesses each having a sectional shape similar to that of the contact adhesion generating recess 40A shown in FIG. 7A or two contact adhesion generating recesses each having a sectional shape similar to that of the contact adhesion generating recess 40B shown in FIG. 7B may be arranged one above the other in the direction perpendicular to the surface 21B of the contact section 21.

It should be noted that the contact adhesion generating recesses 40A to 40E shown in FIGS. 7A to 7E are only examples and the shape of a contact adhesion generating recess is not limited to the above sectional shapes.

Even three or more contact adhesion generating recesses may be arranged one above another in the direction perpendicular to the surface 21B of the contact section 21 for one contact 20 in the same manner.

Embodiment 3

Figure 8:
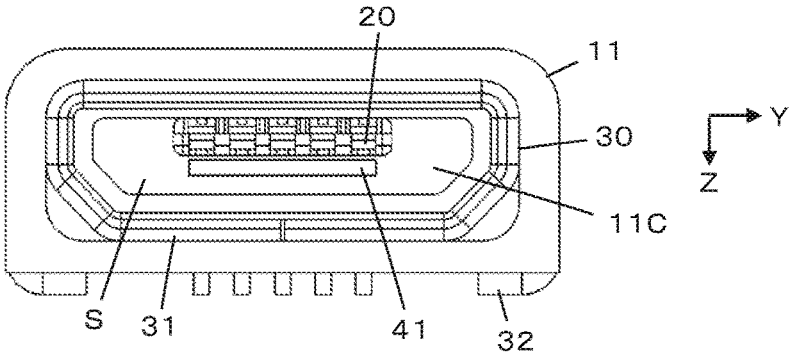
FIG. 8 is a front view showing a waterproof connector of Embodiment 3.

A front view of a waterproof connector according to Embodiment 3 is shown in FIG. 8. In this waterproof connector, in place of the housing 10 in which the plurality of contact adhesion generating recesses 40 are provided in the bottom section 10C, a housing 11 in which a single contact adhesion generating recess 41 is formed in a bottom section 11C is used in the waterproof connector of Embodiment 1. The configuration other than the above is the same as that of the waterproof connector of Embodiment 1.

The contact adhesion generating recess 41 formed in the bottom section 11C of the housing 11 in a corresponding manner to the plurality of contacts 20 extends in the Y direction, which is the arrangement direction of the contacts 20, and is disposed near the +Z direction sides of the respective contacts 20.

Even with the contact adhesion generating recess 41 thus configured, when an electronic device to which the waterproof connector is attached sinks in water and the inside of the counter connector accommodating section S of the waterproof connector is immersed in water, water also enters the contact adhesion generating recess 41 communicating with the counter connector accommodating section S and the water pressure P is applied to the inner wall surface of the contact adhesion generating recess 41, whereby an adhesion force directed to the contact-side fixed sections 23 is generated at the portion of the housing 11 in contact with the contact-side fixed sections 23 of the contacts 20. Thus, it is possible to prevent the housing 11 from separating from the contact-side fixed sections 23 of the respective contacts 20 to improve waterproof properties, as with the waterproof connector of Embodiment 1.

In this Embodiment 3, the single contact adhesion generating recess 41 is formed in a corresponding manner to the plurality of contacts 20 and therefore, the structure of the waterproof connector can be advantageously simplified.

The sectional shape of the contact adhesion generating recess 41 in an XZ plane is not particularly limited and may be, for instance, any of the shapes shown in FIGS. 6 and 7A to 7E.

Embodiment 4

Figure 9:
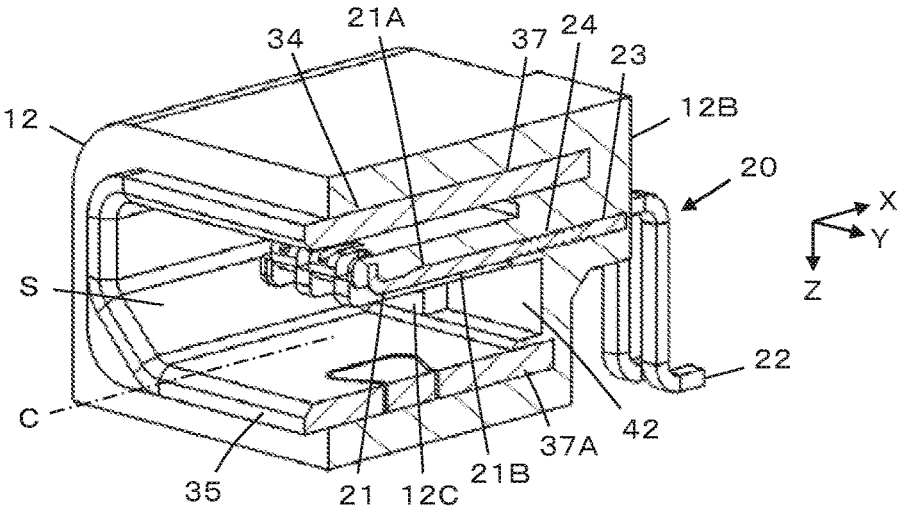
FIG. 9 is a perspective view showing a waterproof connector according to Embodiment 4 cut at the position where one contact lies.
Figure 10:
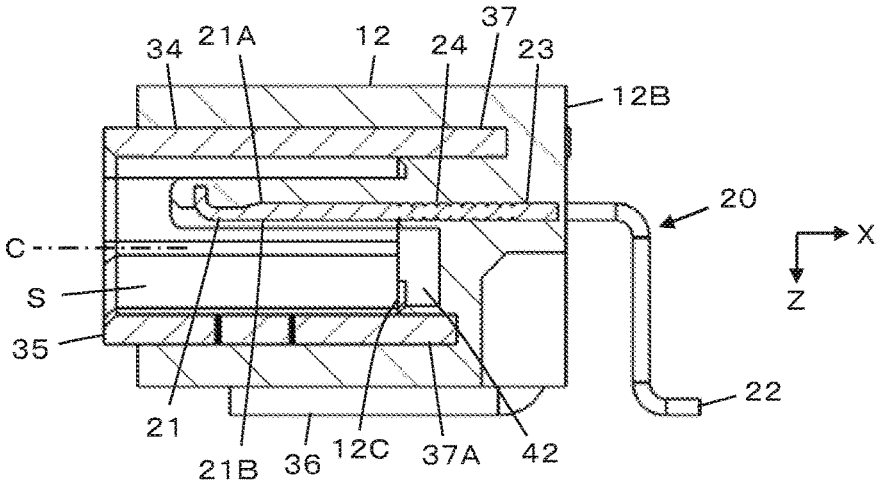
FIG. 10 is a cross-sectional view showing the waterproof connector according to Embodiment 4 cut at the position where one contact lies.

The structure of a waterproof connector according to Embodiment 4 is shown in FIGS. 9 and 10. In this waterproof connector, a shell 34 is used instead of the shell 30 and a housing 12 is used instead of the housing 10 in the waterproof connector of Embodiment 1.

Similarly to the shell 30 used in Embodiment 1, the shell 34 includes a hollow fitted section 35 disposed in the counter connector accommodating section S, a pair of shell-side board connecting sections 36 exposed to the outside of the housing 12, and a shell-side fixed section 37 that connects the fitted section 35 and the pair of shell-side board connecting sections 36 and is embedded in the housing 12. The fitted section 35 and the shell-side board connecting section 36 are the same as the fitted section 31 and the shell-side board connecting section 32 of the shell 30 used in Embodiment 1.

The shell-side fixed section 37 extends in the +X direction from a +X direction-side end of a −Z direction-side portion of the hollow fitted section 35 in the housing 12 and further extends through the housing 12 to be connected to the pair of shell-side board connecting sections 36 as with the shell-side fixed section 33 of the shell 30 used in Embodiment 1, and aside from that, the shell-side fixed section 37 has an extension section 37A extending in the +X direction from a +X direction-side end of a +Z direction-side portion of the fitted section 35 in the housing 12.

Figure 11:
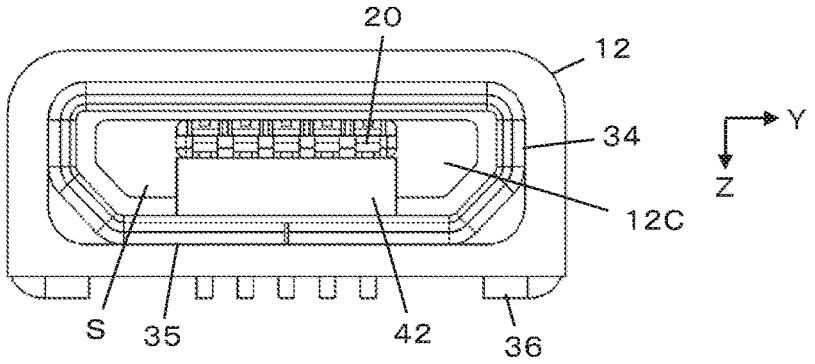
FIG. 11 is a front view showing the waterproof connector of Embodiment 4.

The housing 12 has, in its bottom section 12C provided in the direction of the fitting axis C, an adhesion generating recess 42 that is in a shape recessed along the fitting axis C toward the rear surface 12B of the housing 12 over the area extending from a root region of the contact sections 21 of the contacts 20 in the vicinity of the surface 21B facing in the +Z direction to the vicinity of the extension section 37A of the shell 34 and that communicates with the counter connector accommodating section S. As shown in FIG. 11, the adhesion generating recess 42 has the −Z direction-side end extending in the Y direction, which is the arrangement direction of the contacts 20, and being positioned near the +Z direction sides of the contacts 20, and the +Z direction-side end being positioned near the −Z direction side of the extension section 37A of the shell 34.

Other than the adhesion generating recess 42, the housing 12 has the same configuration as the housing 10 used in Embodiment 1.

When an electronic device to which the waterproof connector is attached sinks in water and the inside of the counter connector accommodating section S of the waterproof connector is immersed in water, water also enters the adhesion generating recess 42 and the water pressure P is applied to the inner wall surface of the adhesion generating recess 42. Meanwhile, the housing 12 is supported by a board or casing of the electronic device, while the extension section 37A of the shell 34 is supported by the housing 12, and the −Z direction-side end of the adhesion generating recess 42 is positioned near the contacts 20, while the +Z direction-side end thereof is positioned near the extension section 37A of the shell 34. Owing to this configuration, the water pressure P applied to the inner wall surface of the adhesion generating recess 42 allows an adhesion force directed to the contact-side fixed sections 23 of the contacts 20 to be generated at the portion of the housing 12 in contact with the contact-side fixed sections 23, and at the same time, allows an adhesion force directed to the extension section 37A of the shell 34 to be generated at the portion of the housing 12 in contact with the extension section 37A.

That is, the adhesion generating recess 42 doubles as a contact adhesion generating recess for allowing an adhesion force directed to the contact-side fixed sections 23 of the contacts 20 to be generated at the housing 12 and a shell adhesion generating recess for allowing an adhesion force directed to the extension section 37A of the shell 34 to be generated at the housing 12.

As a result, the housing 12 can be prevented from separating from the contact-side fixed sections 23 of the contacts 20 and the extension section 37A of the shell 34, thereby improving waterproof properties.

While the single adhesion generating recess 42 corresponding to the contacts 20 and the shell 34 is provided in the bottom section 12C of the housing 12 in Embodiment 4, a plurality of adhesion generating recesses 42 divided in the arrangement direction of the contacts 20 may be provided.

Aside from that, when a shell-side waterproof shaped section composed of a plurality of grooves or protrusions arranged in parallel to each other and configured to block the entry of water along the interface between the shell-side fixed section 37 and the housing 12 is formed around the outer peripheral surface of the shell-side fixed section 37, this can improve a waterproof effect for the shell 34 in combination with the effect of preventing the housing 12 from separating from the extension section 37A of the shell 34 brought by the existence of the adhesion generating recess 42.

Embodiment 5

Figure 12:
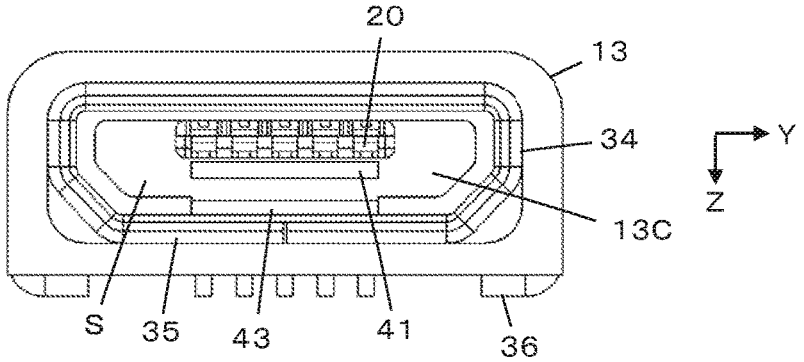
FIG. 12 is a front view showing a waterproof connector of Embodiment 5.
Figure 13:
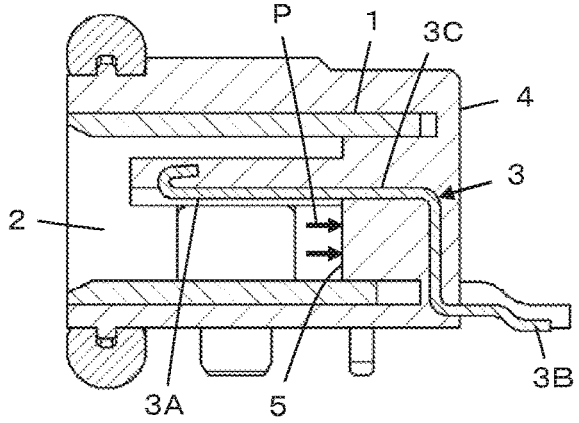
FIG. 13 PRIOR ART
FIG. 13 is a cross-sectional view showing the structure of a conventional waterproof connector.

A front view of a waterproof connector according to Embodiment 5 is shown in FIG. 12. In this waterproof connector, in place of the housing 12 in which the adhesion generating recess 42 is provided in the bottom section 12C, a housing 13 in which a single contact adhesion generating recess 41 and a single shell adhesion generating recess 43 are formed independently of each other in a bottom section 13C is used in the waterproof connector of Embodiment 4. The configuration other than the above is the same as that of the waterproof connector of Embodiment 4.

As with the contact adhesion generating recess 41 used in the waterproof connector of Embodiment 3, the contact adhesion generating recess 41 formed in the bottom section 13C of the housing 13 extends in the Y direction and is positioned near the +Z direction sides of the contacts 20. When the inside of the counter connector accommodating section S of the waterproof connector is immersed in water, the contact adhesion generating recess 41 allows an adhesion force directed to the contact-side fixed sections 23 of the contacts 20 to be generated at the portion of the housing 13 in contact with the contact-side fixed sections 23 by means of the water pressure P acting on the inner wall surface of the contact adhesion generating recess 41.

On the other hand, the shell adhesion generating recess 43 is positioned near the −Z direction side of the extension section 37A of the shell 34, and when the inside of the counter connector accommodating section S of the waterproof connector is immersed in water, the shell adhesion generating recess 43 allows an adhesion force directed to the extension section 37A of the shell 34 to be generated at the portion of the housing 13 in contact with the extension section 37A by means of the water pressure P acting on the inner wall surface of the contact adhesion generating recess 43.

Thus, when the contact adhesion generating recess 41 and the shell adhesion generating recess 43 are formed independently of each other, the housing 13 can still be prevented from separating from the contact-side fixed sections 23 of the contacts 20 and the extension section 37A of the shell 34, thereby improving waterproof properties as with the waterproof connector of Embodiment 4.

The sectional shape of the shell adhesion generating recess 43 in an XZ plane is not particularly limited and may be, for instance, the same as any of the sectional shapes of the contact adhesion generating recesses 40 and 40A to 40E shown in FIGS. 6 and 7(A) to 7(E).

While five contacts 20 are arranged in the Y direction in Embodiments 1 to 5 above, the number of contacts 20 is not limited to five and the present invention is broadly applicable to any connector having one or more contacts 20.

When a shield against electromagnetic waves is not required, this invention may be applied also to a connector having no shell 30 or 34.

What is claimed is:

1. A waterproof connector comprising:

a housing made of an insulating resin and having a counter connector accommodating section that is a recess opening in a fitting direction in which the waterproof connector is fitted with a counter connector and that accommodates the counter connector; and one or more contacts formed integrally with the housing, wherein the one or more contacts each have a contact section projecting from, as viewed in the fitting direction, a bottom section of the counter connector accommodating section of the housing in the counter connector accommodating section so as to be connected to a contact of the counter connector, a contact-side board connecting section exposed from the housing and connected to a board, and a contact-side fixed section connecting the contact section and the contact-side board connecting section and embedded in the housing, and wherein the housing has at least one contact adhesion generating recess that is formed in the bottom section of the counter connector accommodating section to communicate with an inside of the counter connector accommodating section and that allows an adhesion force directed to the contact-side fixed section of each of the one or more contacts to be generated at a portion of the housing in contact with the contact-side fixed section by means of water pressure occurring when the inside of the counter connector accommodating section is immersed in water.

2. The waterproof connector according to claim 1, wherein the contact section of each of the one or more contacts has a pair of surfaces extending along the fitting direction and being opposite from each other, one of the pair of surfaces being in contact with the housing and another of the pair of surfaces being disengaged in the counter connector accommodating section, and wherein the at least one contact adhesion generating recess is positioned at a root region of the contact section near the other of the pair of surfaces.

3. The waterproof connector according to claim 1, wherein the at least one contact adhesion generating recess is in a shape recessed from the bottom section of the counter connector accommodating section along the fitting direction.

4. The waterproof connector according to claim 1, wherein the housing is formed integrally with a plurality of the contacts arranged, and wherein the housing has the at least one contact adhesion generating recess in a corresponding manner to the plurality of the contacts.

5. The waterproof connector according to claim 1, wherein the housing is formed integrally with a plurality of the contacts arranged, and wherein the housing has the one contact adhesion generating recess extending in an arrangement direction of the plurality of the contacts.

6. The waterproof connector according to claim 1, further comprising:

a shell having a fitted section disposed in the counter connector accommodating section of the housing so as to be fitted with the counter connector, a shell-side board connecting section exposed from the housing and connected to the board, and a shell-side fixed section connecting the fitted section and the shell-side board connecting section and embedded in the housing, wherein the housing has at least one shell adhesion generating recess that is formed in the bottom section of the counter connector accommodating section to communicate with the inside of the counter connector accommodating section and that allows an adhesion force directed to the shell-side fixed section of the shell to be generated at a portion of the housing in contact with the shell-side fixed section by means of water pressure occurring when the inside of the counter connector accommodating section is immersed in water.

7. The waterproof connector according to claim 6, wherein the at least one shell adhesion generating recess is in a shape recessed from the bottom section of the counter connector accommodating section along the fitting direction.

8. The waterproof connector according to claim 6, wherein the housing has at least one adhesion generating recess that doubles as the contact adhesion generating recess and the shell adhesion generating recess.

* * * * *